US008474354B2

(12) United States Patent
Horton

(10) Patent No.: US 8,474,354 B2
(45) Date of Patent: Jul. 2, 2013

(54) METHOD OF CUTTING FOOD

(76) Inventor: Mark Horton, Burlington, VT (US)

( * ) Notice: Subject to any disclaimer, the term of this patent is extended or adjusted under 35 U.S.C. 154(b) by 1145 days.

(21) Appl. No.: 11/937,918

(22) Filed: Nov. 9, 2007

(65) Prior Publication Data

US 2008/0307938 A1 Dec. 18, 2008

Related U.S. Application Data

(63) Continuation of application No. 10/762,642, filed on Jan. 20, 2004, now abandoned.

(60) Provisional application No. 60/454,949, filed on Mar. 12, 2003.

(51) Int. Cl.
*B26B 25/00* (2006.01)

(52) U.S. Cl.
USPC ..... 83/13; 30/292; 30/319

(58) Field of Classification Search
USPC 30/319, 307, 164.95, 365, 114, 292; D7/694; 83/13
See application file for complete search history.

(56) References Cited

U.S. PATENT DOCUMENTS

| | | | | | |
|---|---|---|---|---|---|
| 3,601,893 | A | * | 8/1971 | Knox | 30/366 |
| D222,380 | S | * | 10/1971 | Fraioli | D7/694 |
| 4,161,819 | A | * | 7/1979 | Pietrantonio | 30/164.95 |
| 4,203,209 | A | * | 5/1980 | Insolio | 30/164.95 |
| 4,215,472 | A | * | 8/1980 | Raven | 30/164.95 |
| 4,327,488 | A | * | 5/1982 | Connolly | 30/164.95 |
| 4,380,122 | A | * | 4/1983 | Jagger | 30/343 |
| 4,528,752 | A | * | 7/1985 | Benedict | 30/164.95 |
| 4,809,437 | A | * | 3/1989 | Saliaris | 30/319 |
| 4,819,535 | A | * | 4/1989 | Thomas | 30/164.95 |
| 5,027,511 | A | * | 7/1991 | Miller | 30/526 |
| 5,100,391 | A | * | 3/1992 | Schutte et al. | 30/304 |
| 5,144,749 | A | * | 9/1992 | Chen | 30/319 |
| D392,162 | S | * | 3/1998 | Henry et al. | D7/694 |
| 5,908,036 | A | * | 6/1999 | Andrews | 30/30 |
| 5,920,991 | A | * | 7/1999 | Tracy | 30/314 |
| 6,044,565 | A | * | 4/2000 | Arend et al. | 30/319 |
| 6,327,783 | B1 | * | 12/2001 | Ming | 30/319 |
| 6,502,314 | B1 | * | 1/2003 | McCatty | 30/340 |
| D474,081 | S | * | 5/2003 | Rather et al. | D7/694 |
| 6,584,694 | B2 | * | 7/2003 | Chen | 30/307 |
| 6,598,302 | B1 | * | 7/2003 | Peppel et al. | 30/342 |
| 2004/0177515 | A1 | * | 9/2004 | Horton | 30/319 |
| 2004/0187318 | A1 | * | 9/2004 | Mathieu et al. | 30/319 |
| 2005/0022390 | A1 | * | 2/2005 | Whitemiller et al. | 30/293 |

FOREIGN PATENT DOCUMENTS

| | | | | |
|---|---|---|---|---|
| GB | 2271738 | A | * | 4/1994 |
| WO | WO 9106405 | A1 | * | 5/1991 |

* cited by examiner

*Primary Examiner* — Jason Daniel Prone
(74) *Attorney, Agent, or Firm* — John F. Klos; Briggs and Morgan, P.A.

(57) ABSTRACT

A cutting device for food products having a handle, a neck portion, and a circular cutting blade. The handle is generally curved relative to its longitudinal axis and includes a top surface with a finger stop, the finger stop engaging a user's index finger during use. The handle length is sized in proportion to a typical user's hand so that a free end of the handle is proximate the user's palm. During use, the user's index finger engages a finger stop and top and bottom surfaces of the handle. A method of using such a flat food item cutting device is also disclosed.

4 Claims, 3 Drawing Sheets

METHOD OF CUTTING FOOD

RELATED APPLICATIONS

This application is a continuation of U.S. Ser. No. 10/762,642, filed Jan. 20, 2004, which claimed the benefit of priority, pursuant to 35 U.S.C. §119, of U.S. Provisional Patent Application, Ser. No. 60/454,949, filed Mar. 12, 2003, hereby incorporated by reference herein in its entirety.

BACKGROUND OF THE INVENTION

Utensils for cutting pizza into slices for human consumption are known in the prior art. Specialized tools to cut pizza are also known. Such pizza cutters typically include a circular blade attached to a handle. The handle is generally relatively substantial in comparison to the size of a knife or fork handle. The cutting blade is attached to the handle and, in operation, rotates relative to the handle in a plane perpendicular to the surface of the pizza. The circular blade thus forms a cutting wheel which allows the user to cut the pizza by rolling the cutting wheel across the pizza while applying downward pressure. Typically, a user grasps the pizza cutter in a clenching manner, with the user's fingers encircling the handle, e.g. similar to gripping a bicycle handle bar. The known pizza cutters are generally used to cut the pizza into large triangular pieces. Individual knifes and forks are subsequently used to further cut the pizza into bite-sized pieces. Use of known rotary pizza cutters requires a level of manual dexterity that some users may not possess. For example, children or elderly may have difficulty manipulating the cutter in such a manner to cut pizza.

Prior art pizza cutters and relevant other cutters are disclosed in U.S. Pat. Nos. D0448611; D0393987, RE032501, D0232413, 4,809,437, 0,388,305, D0346542, 5,428,898, D0341764, 5,144,749, D0350462, D0222380, D0461380, D0433912, 5,555,625, 5,737,803 and 06044565, each patent being incorporated by reference herein for all that it teaches and discloses.

SUMMARY OF THE INVENTION

The present invention relates to a manual cutting device of the type having a disc-like circular blade rotatably mounted to a handle and a method for cutting pizza or other relatively thin planar food stuffs.

The present invention is directed to a cutting device which includes a circular blade rotatably mounted on a handle. The cutting device is designed to be grasped and used in a manner similar to a steak knife, with the index finger on the top of the handle and the other fingers wrapped around the handle. The cutting device may be used in place of a knife and allows the user to cut food into bite-sized pieces. A method of use of the cutting device is also disclosed.

DETAILED DESCRIPTION

Figure 1:
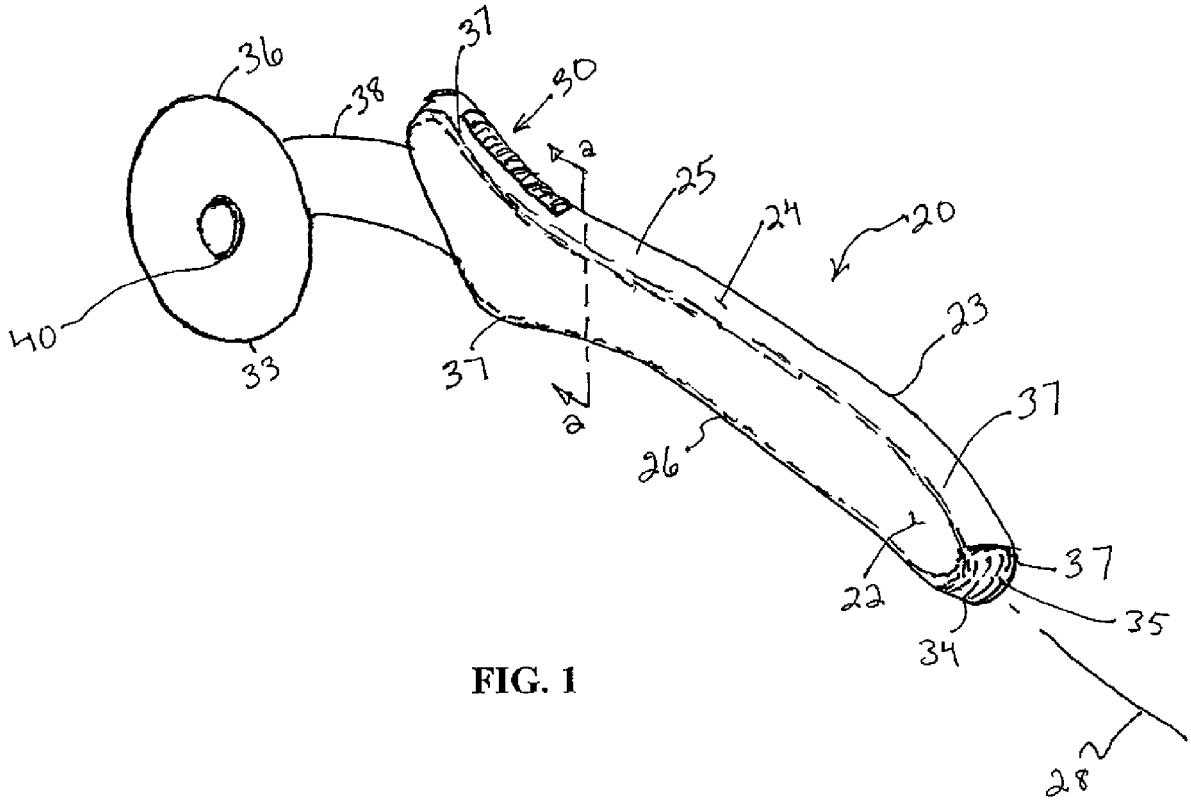
FIG. 1 is a left side perspective view of a cutting device for pizza and similar food products constructed in accordance with the present invention.
Figure 1A:
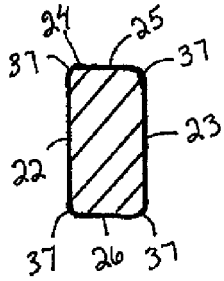
FIG. 1*a* is a sectional view of the cutting device of FIG. 1 taken along lines a-a.
Figure 2:
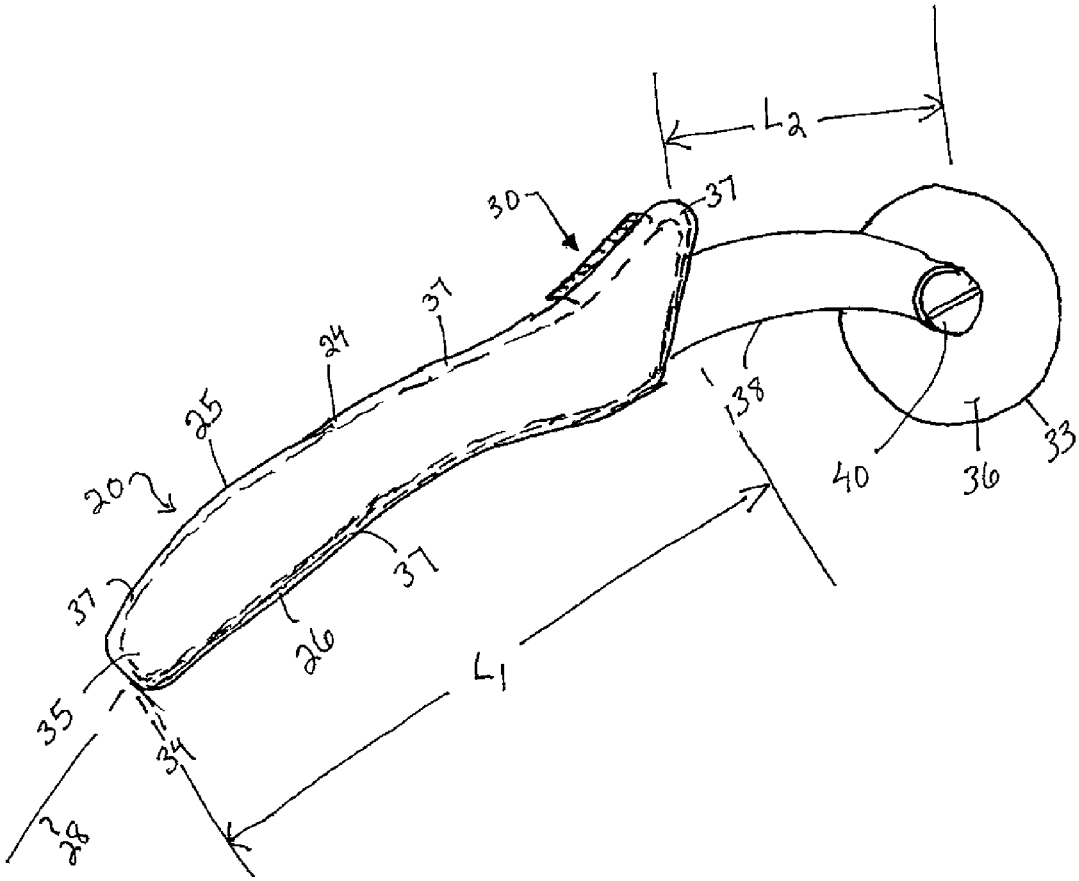
FIG. 2 is a right side perspective view of the cutting device shown in FIG. 1.
Figure 3:
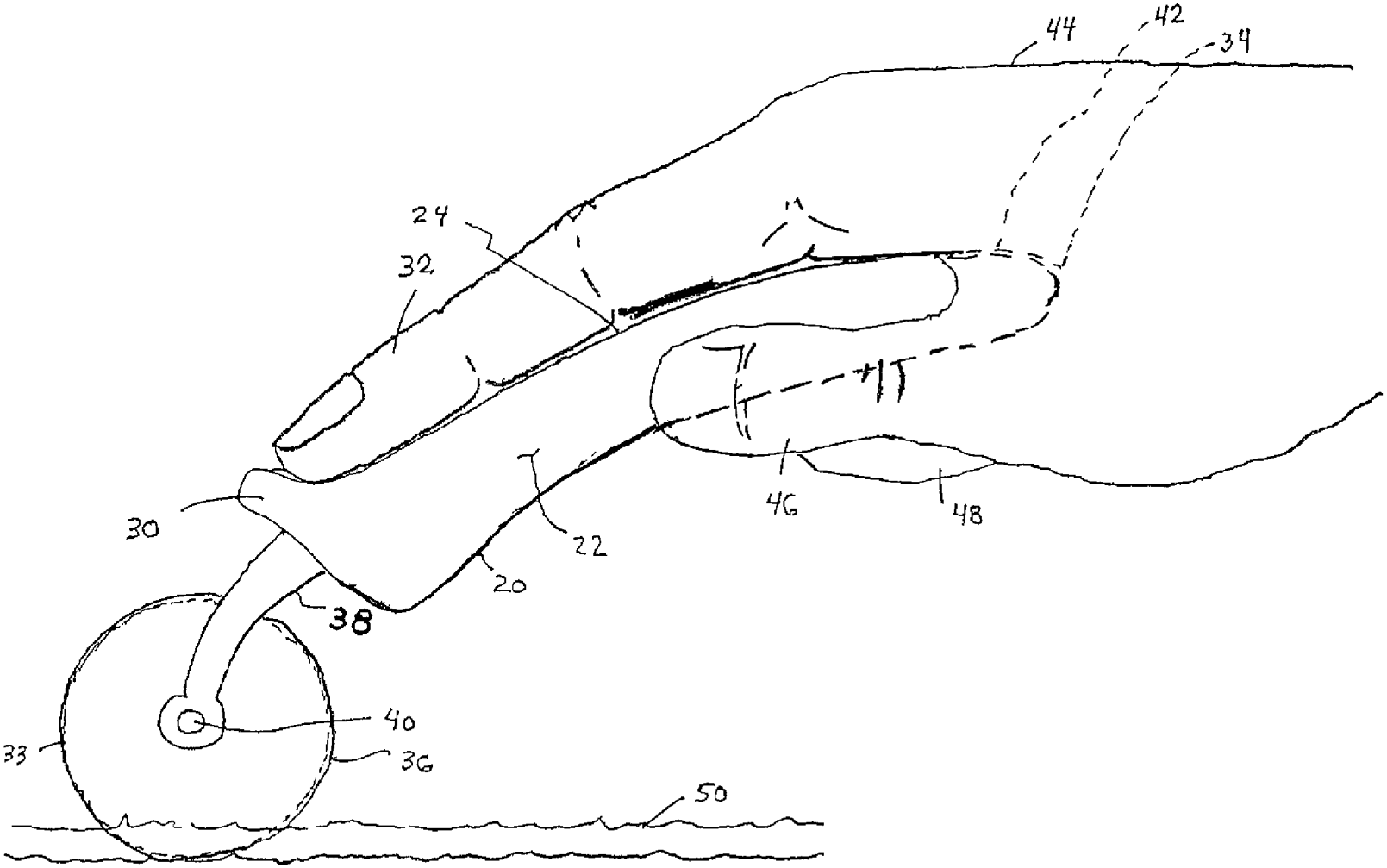
FIG. 3 is an illustration of the cutting device of FIGS. 1 and 2 as being grasped by a user.

A cutting device for food products and the like, constructed in accordance with the present invention, is shown in FIGS. 1, 2 and 3 and includes a handle portion, indicated generally at 20, which facilitates manual manipulation of the device.

Handle 20 includes two generally flat outer side surfaces 22, 23, a flat top surface 24, and a flat bottom surface 26. Handle 20 may be manufactured of a variety of materials as appreciated by one of ordinary skill in the art. For example, handle 20 may be plastic, wood, metal, etc. In one preferred embodiment, handle 20 is approximately 6 inches long and ¾ inch wide (distance between side surfaces 22, 23). Handle 20 width in alternative embodiments may range from approximately ¼ inch to ¾ inch. The variation in the length of handle 20 is further discussed below. Top surface 24 is generally curved relative to a longitudinal axis 28 of handle 20. As illustrated in the Figures, side surfaces 22, 23 are parallel to each other and are perpendicular to the flat top and bottom surfaces.

Top surface 24 of handle 20 defines a portion 25 upon which a user's index finger 32 is engaged during use as indicated in FIG. 3. Portion 25 promotes stability of the device during usage. The finger stop structure 30 promotes intuitive placement of the user's finger 32. The bottom surface 26 of handle 20 may further include one or more finger ridges (not shown) for engaging a user's finger during use. Finger stop structure 30 may include a configured surface, such as grooves, etc. (not shown) to minimize finger slippage relative to handle 20. Similarly, finger stop structure 30 may include an insert of different material, such as a rubber or silicone material, to minimize finger slippage. As illustrated in FIG. 3, top surface 24 is proportioned for receipt of an engaging surface of a human index finger 32. The handle 20 may also include an inclined top surface 24 which cooperates with the finger stop structure to reduce slipping of the fingers. Handle 20 may also include a finger guard (not shown).

As illustrated in FIG. 3, handle 20 is sized in proportion to a users hand 44. Preferably, handle 20 is sized so that its free end 34 is received within a user's palm 42 during use. As a result, the length, L1, of handle 20 is between approximately 4½ to 7 inches. More preferably, LI of handle 20 is between approximately 5 to 6½ inches. Yet more preferably, L1 of handle 20 is approximately 6 inches. Free end 34 of handle 20 is tapered and ends with a circular surface 35 transitioning from top surface 24 to bottom surface 26. A circular rounding 37 defines a transition between bottom surface 26, top surface 24 and side surfaces 22, 23. Circular rounding 37 extends entirely around a perimeter of the side surfaces 22, 23.

In one embodiment, a disc-shaped, circular cutting blade/cutting wheel 36 is rotatably mounted to handle 20 via an elongated neck portion 38. The neck portion 38 is curved/arcuate and is at least twice the diameter of cutting wheel 36. Neck portion 38 has a length, L2, which is substantially greater than the diameter of cutting wheel 36. Preferably, the ratio between L2 and the diameter of cutting wheel 36 ranges from 2-4:1, that is, neck portion 38 has a length of between 2 to 4 times the diameter of cutting wheel 36. This enables the user to safely position his fingers further away from the blade and to provide greater leverage at the tip of the blade. Blade 36 includes a sharp outer edge 33 forming a cutting surface. Blade 36 is rotatably secured to neck 38 through an axle 40. Blade 36 has a diameter between approximately 1½ and 2 inches. In one preferred embodiment, blade 36 has a diameter of approximately 2 inches. Neck 38 is secured to handle 20 and extends about 2 to 3 inches from the handle. The diameter of the blade 36 to the combined length of the handle 20 and neck 38 (L1+L2) is about 1 to 3. This enables the present invention to utilize a generally smaller diameter blade 36 while maintaining sufficient cutting force during usage.

In a preferred method of use, as illustrated in FIG. 3, free end 34 of handle 20 engages the palm 42 of a user's hand 44. The user's thumb 46 engages side surface 22, while other fingers 48 engage opposite side surface 23. Index finger 32 engages top surface 24 and finger stop 30. As can be appreciated, the overall geometry of handle 22 is sized to be held within the palm 42 of a typical user's hand 44. Pizza or other flat food item 50 is cut by rolling wheel 36 across the pizza or food item 50.

As applicable to pizza or the like, a cutter according to the present invention is particularly useful when a product has a harder, crisper crust or is unusually thick and conveniently aids a user having lesser strength or dexterity, such as a child, women or elderly persons.

It should be also noted that the construction of the present invention lends itself to manufacture employing molded plastic parts which are easily assembled to provide an inexpensive, but durable cutting device having the aforementioned advantages.

The invention of this application is described above both generically and with regard to specific embodiments. A wide variety of alternatives known to those of ordinary skill in the art can be selected within the generic disclosure. The examples provided herein are not to be limited by the examples, but rather, the claims are considered to provide the complete scope of the invention.

What is claimed is:

1. A method of cutting substantially flat foods comprising:

providing a cutting device having a cutting wheel attached to a first end of a handle having a curved top surface and curved bottom surface extending between the first end and a second end, said handle further including a pair of parallel side surfaces extending from the first end to the second end, with said second end being tapered, said top surface extending away from the second end with a first portion being curved in a first direction and a finger stop being curved in a direction opposite the first portion, with said finger stop including an insert extending from a top surface of the finger stop and being aligned substantially parallel to said pair of parallel side surfaces;

placing an index finger of a user longitudinally along the curved top surface of the handle with a tip of the index finger engaging the insert of the finger stop, with the index finger curving along the second portion of the handle and a user's palm containing the second end of the handle while the tip of the index finger is maintained against the finger stop;

engaging one of the pair of side surfaces with a thumb finger of the user while maintaining the tip of the index finger against the finger stop;

engaging the other of the pair of side surfaces with one or more fingers of the user adjacent to the user's index finger; and rolling the cutting wheel across the flat food item to cut the food item with the index finger tip engaging the stop structure, a portion of the index finger engaging the top surface and the second end of the handle engaging the palm of the user.

2. The method of claim 1 wherein the top surface and the bottom surface remain perpendicular to the parallel side surfaces between the first end and the second end of the handle.

3. The method of claim 2 wherein a circular rounding defines a transition between the bottom surface, the top surface and the side surface.

4. The method of claim 3 wherein the circular rounding extends entirely around a perimeter of the side surface.

* * * * *